US005419733A

United States Patent [19]

Johnson et al.

[11] Patent Number: 5,419,733

[45] Date of Patent: May 30, 1995

[54] METHOD OF AND APPARATUS FOR REMOVING DEBRIS FROM THE FLOPTICAL MEDIUM

[75] Inventors: Paul R. Johnson, Kaysville; James Bero, Ogden; Jeff G. Carter, Morgan; Anthony M. Candia, Harrisville; George T. Kieger, Salt Lake City; Ronald F. Hales, Roy; Fred C. Thomas, III, Kaysville, all of Utah

[73] Assignee: Minnesota Mining and Manufacturing Company, St. Paul, Minn.

[21] Appl. No.: 177,789

[22] Filed: Jan. 5, 1994

Related U.S. Application Data

[63] Continuation of Ser. No. 902,064, Jun. 22, 1992, abandoned.

[51] Int. Cl.[6] ..... B24C 1/00; B24C 3/22

[52] U.S. Cl. ..... 451/39; 451/53; 451/82

[58] Field of Search ..... 51/322, 319–321, 51/419–421, 424, 425, 413; 451/53, 38, 39, 40, 82, 83, 84, 87, 88, 78

[56] References Cited

U.S. PATENT DOCUMENTS

| | | | |
|---|---|---|---|
| 3,992,819 | 11/1976 | Schmall | 51/413 |
| 4,806,171 | 2/1989 | Whitlock | 51/320 |
| 4,869,090 | 9/1989 | Tada et al. | 51/320 |
| 4,962,891 | 10/1990 | Layden | 51/320 |
| 4,974,375 | 12/1990 | Tada et al. | 51/320 |
| 5,196,034 | 3/1993 | Ono et al. | 51/413 |

FOREIGN PATENT DOCUMENTS

| | | | |
|---|---|---|---|
| 0223563 | 12/1983 | Japan | 51/320 |

OTHER PUBLICATIONS

Y. Y. Fan and V. M. Huynh, "Investigation of Light Scattering From Rough Periodic Surfaces–Numbered Solutions", Dept. of Mech. Eng. Univ. of Windsor, Ontario, Mar. 1992.

J. Mazumder, "Overview of Melt Dynamics in Laser Processing", Optical Engin. vol. 30, No. 8, pp. 1208–1219 Aug. 1991.

M. W. Sasnett and T. F. Johnston, Jr., "Beam Characterization and Measurement of Propagation Attributes", Laser Beam Diagnostics, SPIE vol. 1414, Los Angeles 1991.

F. Jorgensen, "The Complete Handbook of Magnetic Recording" 3rd Edition, TAB Books, Inc., Blue Ridge Summit, Pa. 1988 pp. 119–121.

SNO GUN Cleaner, Cleaning with Dry Ice Snow, 13 pages Hafstrom Technical Products, Inc. San Diego, Calif.

SNO GUN TM Cleaner Description and Operating Instructions, Halstrom Tech. Prods. Inc. pp. 1–5.

SNO GUN TM Cleaner Description and Operating Instructions Va–Tran Systems, Inc. pp. 1–4.

SNO GUN Dry Snow Cleaning System for Electronic, Semi–Conductor, Medical, Optical and Other Diverse Indus. Va–Tran Systems, Inc. pp. 1 and 2.

Dry Surface Cleaning with $CO_2$ Snow by Wlater H. Whitlock The BOC Group, Inc. presented at the 20th Ann. Meeting of the Fine Particle Soc., Boston, Mass. Aug. 22, 1989.

*Primary Examiner*—Robert A. Rose

*Attorney, Agent, or Firm*—Gary L. Griswold; Walter N. Kirn; Eric D. Levinson

[57] ABSTRACT

The current invention substantially removes particulate waste materials or debris from the floptical medium after laser etching. A low-temperature gas containing ice crystals is applied at a predetermined angle while the floptical medium is being rotated to improve the cleaning effect. The temperature of the disk is maintained above freezing to maintain the cleaning effect.

40 Claims, 2 Drawing Sheets

FIG. 1
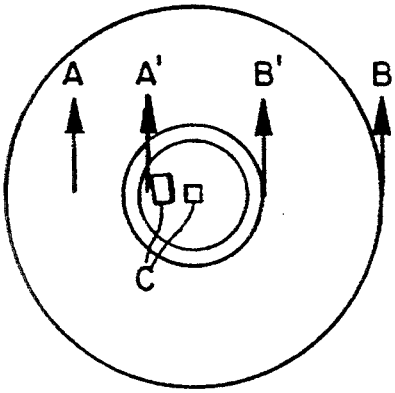
FIG. 2
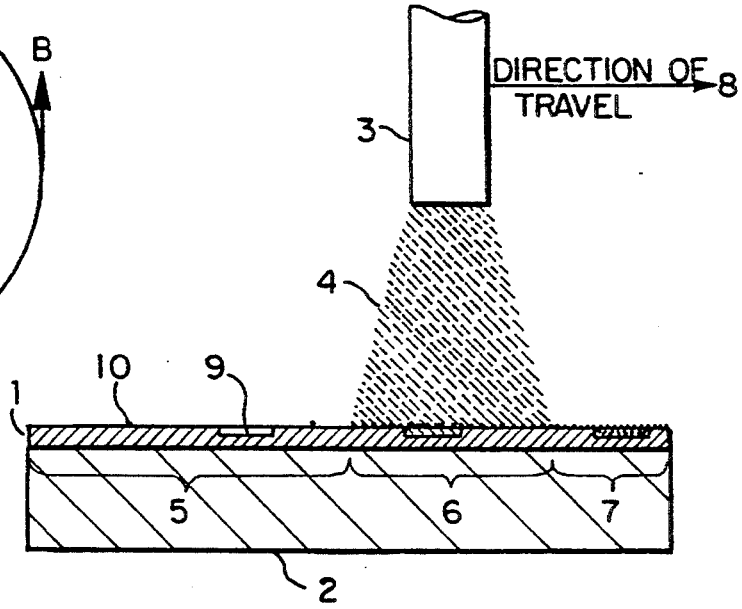
FIG.3B
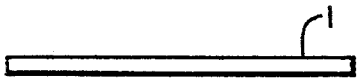
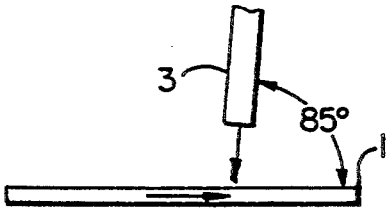
FIG. 3C
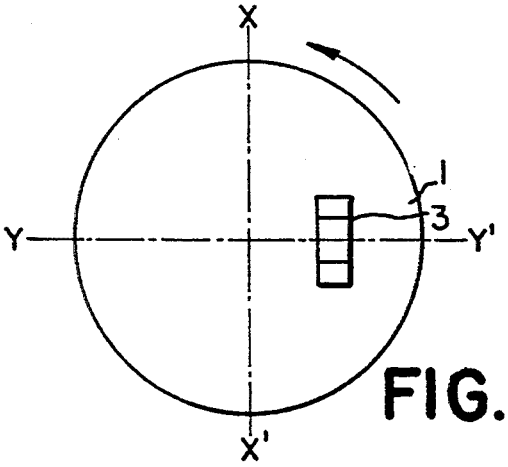
FIG.3A
FIG.4B
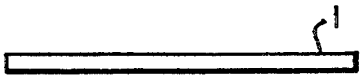
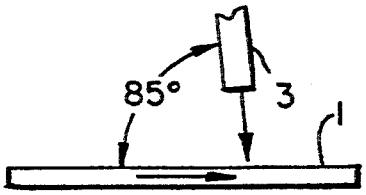
FIG.4C
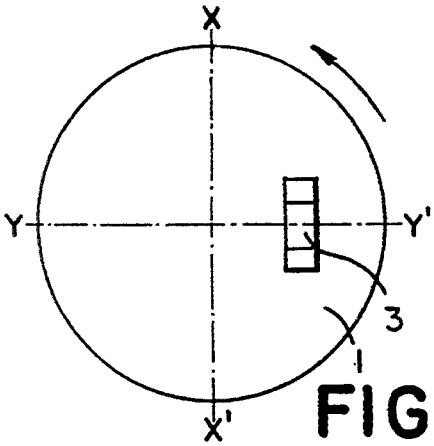
FIG. 4A

METHOD OF AND APPARATUS FOR REMOVING DEBRIS FROM THE FLOPTICAL MEDIUM

This is a continuation of application Ser. No. 07/902,064, filed Jun. 22, 1992, now abandoned.

FIELD OF THE INVENTION

This invention relates to a method of cleaning floptical media, and in particular to removing microscopic debris from the floptical media surface and grooves after laser etching.

BACKGROUND OF THE INVENTION

Recently, floppy disk systems have been developed that combine magnetic disk recording techniques with the high track capacity servos found in optical disk systems. Such a system is described in AN INTRODUCTION TO THE INSITE 325 FLOPTICAL(R) DISK DRIVE, Godwin, which was presented at the SPIE Optical Data Storage Topical Meeting (1989). Essentially, an optical servo pattern is pre-recorded on a magnetic floppy disk. The optical servo pattern typically consists of a large number of equally spaced concentric tracks about the rotational axis of the disk. Data is stored in the magnetic "tracks" between the optical servo tracks using conventional magnetic recording techniques. An optical servo mechanism is provided to guide the magnetic read/write head accurately over the data between the optical servo tracks. By utilizing optical servo techniques, much higher track densities are available on the relatively inexpensive removable magnetic medium.

As mentioned, the optical servo pattern typically consists of a large number of equally spaced concentric tracks about the rotational axis of the disk. As disclosed in U.S. Pat. No. 4,961,123, each track may be a single continuous groove (FIG. 3), a plurality of equally spaced circular pits (FIG. 8), or a plurality of short equally spaced grooves or stitches (FIG. 9). Various methods and systems exist for inscribing the optical servo tracks on the magnetic medium. For example, U.S. Pat. No. 4,961,123, entitled "Magnetic Information Media Storage With Optical Servo Tracks," discloses a method of an apparatus etching the servo track pattern on a disk using a laser.

U.S. Applications IOM-8721 and IOM-8723 (filed Jun. 10, 1992) show an apparatus and method for etching intermittent grooves in a floptical disk.

During laser etching of the floptical media, particulate waste is generated. The size of etching debris is in the order of micron or sub-micron. These fine etching debris remain on the floptical media surface as well as in the etched grooves after laser etching is completed. If the floptical medium is not cleaned, these debris damage both the floptical media and the read/write heads of the floptical drive.

Removal of laser etching debris from the floptical medium surface and grooves is a critical step in the manufacturing process. However, it is difficult to remove these microscopic or sub-microscopic debris from the floptical surface. Especially, it is harder to remove microscopic debris remaining in the stitches or grooves. In order to remove these microscopic debris, it has been attempted to wipe the etched floptical surface with synthetic cloth such as Rayon. The cloth was also used with a solution such as deionized water. However, much of the microscopic debris was not removed by this method, and the microscopic debris remained in the stitches. It has also been known in the relevant art that spraying a gas onto other recording media helps remove some undesirable materials. For example, Sno-Gun TM (Va-Tran Systems, Inc. Chula Vista, Calif.) has been used to remove dust from a magnetic floppy disk and flux from printed circuit boards and semiconductors. Sno-Gun TM sprays $CO_2$ pellets onto a medium, *Sno-Gun TM Cleaner, Description and Operating Instructions,* Va-Tran Systems, Inc. While the nozzle of a Sno-Gun travels in a certain direction to remove the undesired materials from the medium, the medium remains stationary. When Sno-Gun TM was applied to a floptical medium as directed in the operating instructions, the removal of the microscopic debris was not complete. Moreover, during the spray cleaning, the low temperature freezes the surface of a floptical medium. This happens especially when the same area is repetitively sprayed with $CO_2$ pellets. Thus, the effectiveness of Sno-Gun TM diminishes as more $CO_2$ pellets are applied.

None of these prior art techniques solved or ever addressed the above mentioned problem of removing sub-microscopic or microscopic debris from the floptical medium after laser etching. Thus, the object of the current invention is to improve the removal of the microscopic and sub-microscopic debris from a floptical medium. Another object of the current invention is to prevent the floptical medium from being frozen during cleaning so that the microscopic debris removal remains effective. Yet another objective is to improve the microscopic debris removal by creating a larger energy disparity between the debris and the disk.

SUMMARY OF THE INVENTION

The apparatus for removing debris from a floptical medium after laser etching comprises a rotating means, a chuck for rotating the floptical medium and a sprayer for spraying a low-temperature gas containing ice crystals onto the rotating floptical medium at a predetermined angle. The ice crystals collide with the debris, and the debris depart from the floptical medium due to a change in momentum created by the collision. Freezing of the floptical medium surface due to the ice crystals is prevented by thermal energy transfer from the chuck.

In another embodiment, an external heat source is applied to the chuck. A low-pressure vacuum is also applied near the rotating floptical medium to further transport the debris that departed from the disk surface.

The method of removing debris from a floptical medium after laser etching comprises the steps of:

a) mounting the medium on the chuck for rotation;
b) rotating the medium,
c) spraying a low-temperature gas containing ice crystals onto the rotating surface; and
d) maintaining the disk surface temperature above freezing. The ice crystals collide with the debris and cause them to depart from the floptical medium. The temperature may be maintained by applying external heat.

BRIEF DESCRIPTION OF THE DRAWINGS

FIG. 1 is a top view of the floptical disk.

FIG. 2 is a cross sectional view of the floptical disk taken at A—A' and the Sno-Gun TM nozzle.

FIG. 3 shows one embodiment where the nozzle is placed in such an angle that the direction of the jet stream is against rotation of the disk.

FIG. 4 shows another embodiment where the nozzle is placed in such an angle that the direction of the jet stream is the same as that of rotation of the disk.

DETAILED DESCRIPTION OF THE PREFERRED EMBODIMENT

Figure 5:
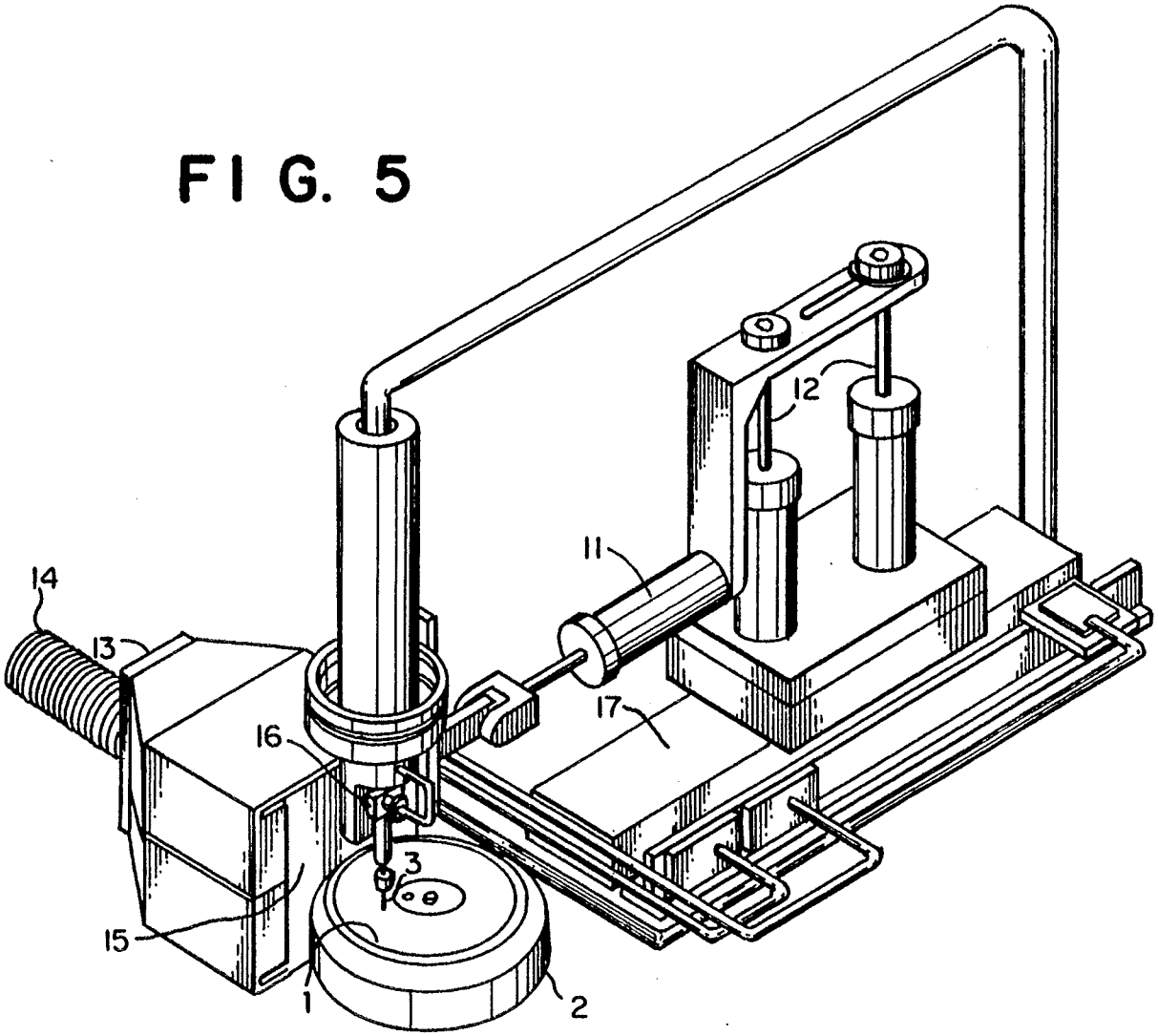
FIG. 5 is a plan view of the floptical disk, the Sno-Gun, the Sno-Gun controlling device and the vacuum device.

FIG. 1 is a top view of a floptical disk 1. The concentric optical servo tracks were etched on the disk surface between B—B'. C is a pair of bores on the floptical disk 1 to engage pins to lock the disk 1 for rotation.

FIG. 2 is a cross sectional view taken at A—A' of FIG. 1. FIG. 2 schematically shows the method of removing submicroscopic debris from the floptical medium. The floptical disk 1 is placed on the chuck 2 for rotation. The laser etched side of the disk is disposed distally to the chuck 2. While the disk 1 is rotated at approximately 2000 rpm, the nozzle 3 of Sno-Gun TM is aimed at the laser etched surface of the disk 1 for spraying $CO_2$ pellets or a jet stream of ice crystals 4. The aforementioned Sno Gun TM is an example of a nozzle suitable for use. The nozzle 3 travels in the horizontal direction as indicated by the arrow 8 from the inner to outer radius of the floptical disk 1. The area 6 is being cleaned, and the area 7 is yet to be cleaned. Throughout the areas, the microscopic or submicroscopic particulate waste materials 10 are shown as black dots. The area 5 has been already cleaned by the method of the current invention. The area 5 has substantially less particulate waste materials 10 than the area 6 or 7 since the areas 6 and 7 have not yet been cleaned. Especially, the stitch 9 has high concentration of particulate materials 10. Each of these particulate waste materials 10 are in the order of microns or less than a micron.

The ice crystals colliding with the debris on the surface of the disk 1 cause the debris to disassociate from the etched surface or stitches. It is believed that the energy transfer between the ice crystals and the debris causes cleaning as suggested by Witlock in *Dry Surface Cleaning with $CO_2$ Snow,* Compressed Air Magazine, August, 1986. Assuming that the disk is stationary, numerous small particles of solid $CO_2$ moving at high velocity hits the particulate materials 10. Upon collisions, the impact of the $CO_2$ pellets transfers sufficient momentum to the particulate waste materials 10 to overcome the particle adhesion force. As a result, the waste materials disassociate from the floptical surface. Once the particulate materials are free from the disk surface, they are transported by the flow of air generated by the jet stream of $CO_2$.

In order to improve this removal mechanism, the floptical disk is rotated during the debris removal in the current invention. Depending upon the direction of the jet stream with respect to that of rotation, the energy transfer between the debris 10 and the disk 1 is in either direction. In one embodiment, the nozzle 3 is placed so that the direction of the jet stream is against rotation of the disk as shown in FIGS. 3A–3C. FIG. 3A is a top view of the disk 1 in relation to the nozzle 3. As indicated by arrows, the disk 1 is rotated counterclockwise. FIG. 3B is a cross sectional view of the top half of FIG. 3A taken at Y—Y'. Because the nozzle 3 is angled, FIG. 3B shows only a distal portion of the nozzle 3. The nozzle 3 is perpendicular to the surface of the disk 1. FIG. 3C is another cross sectional view taken at X—X' of FIG. 3A. The nozzle 3 is angled at 85° from the disk surface in such a way that the direction of the jet stream from the nozzle 3 as shown by an arrow is against the rotational direction. The ice crystals in the $CO_2$ jet stream collide substantially head-on with the debris or particulate waste materials 10 on the surface of the disk 1. Thus, the energy level of the debris decreases due to collision with the $CO_2$ pellets, assuming that the momentum of the ice crystals is larger than that of debris. The debris are decelerated and some energy is dissipated as heat due to collision. This momentum change causes a greater energy difference between the decelerated debris and the rotating disk and the debris to readily depart from the disk. As a result, the disk cleaning with a Sno-Gun is substantially improved over the stationary disk.

In another embodiment, the direction of the jet stream from the nozzle 3 is the same as that of rotation as shown in FIG. 4. FIG. 4A is a top view of the disk 1 in relation to the nozzle 3. As indicated by an arrow, the disk 1 is rotated counterclockwise. FIG. 4B is a cross sectional view of the top half of FIG. 4A taken at Y—Y'. Because the nozzle is angled, FIG. 4B shows only a proximal portion of the nozzle 3. The nozzle 3 is perpendicular to the surface of the disk 1. FIG. 4C is another cross sectional view taken at X—X' of FIG. 4A. The nozzle 3 is angled at 85° from the disk surface in such a way that the direction of the jet stream from the nozzle 3 as shown by an arrow is the same as that of rotation. The ice crystals in the $CO_2$ jet stream collide with the debris substantially in the same direction on the surface of the disk 1. Thus, the energy transfer is from the ice crystals to the debris, and the debris are accelerated. The momentum of the debris is altered so that a greater difference in energy level between the debris and the rotating disk results. This energy difference causes the debris to more readily depart or disassociate from the disk surface than when the $CO_2$ pellets are applied to the stationary disk.

During the course of debris removal, an icy jet stream sprayed onto the floptical disk surface lowers the disk surface temperature. However, a single track must be repetitively sprayed with the icy jet stream to substantially remove the particulate waste materials. Thus, the continuing application of an icy jet stream gradually freezes the disk surface. When the surface is covered with ice, no debris depart or disassociate from the disk surface. As a result, Sno-Gun TM decreases its effectiveness as it repetitively sprays the same track. Although, it is possible to apply heat from an external heat source, the external heat application may require monitoring the disk surface temperature and accordingly adjusting the heat application. The current invention provides a method of and apparatus for maintaining the rotating disk above the freezing temperature during jet spraying of $CO_2$ pellets by providing a heat reservoir in the chuck. An additional external heat source is not necessary in this embodiment. Because the chuck has a substantially larger thermal mass than the disk, lowering of the disk temperature is quickly recovered by heat transfer from the chuck to the disk. The chuck, then, replenishes heat from environment, assuming that the room temperature is above freezing. In another embodiment, the chuck 2 is heated with an external heater (not shown). This allows a quick replenishment of the heat reservoir in the chuck 2. Thus, the current invention simplifies the maintenance of the disk temperature during the microscopic debris removal.

FIG. 5 shows a plan view of the apparatus for removing microscopic and submicroscopic debris from the floptical medium. The floptical disk 1 is placed on the chuck 2. While the disk 1 is being rotated by the chuck 2, a gas containing $CO_2$ pellets is sprayed onto the floptical disk surface through the nozzle 3. The position adjustment means 17 moves the nozzle 3 from the inside to outside radius of the rotating floptical disk 1. The nozzle 3 travels at a predetermined speed so that each track is sprayed with the $CO_2$ gas for at least a couple of times. The height adjustment means 12 keeps a constant distance between the nozzle 3 and the floptical disk surface 1. The angle adjustment means 11 sets the angle of the nozzle in a plane perpendicular to the disk surface. The radial angle adjustment means 16 sets an angle with respect to the radius of the disk 1.

Still referring to FIG. 5, the vacuum means 13 is connected to a low pressure source through the hose 14 and is located near the rotating disk 1. During the cleaning, the vacuum means 13 applies a low pressure gas through the bore 15. The debris departed from the rotating disk 1 due to $CO_2$ spraying are further transported towards the bore 15 by the air flow created by the vacuum.

In the above described apparatus, the best result has been achieved when the following parameters were used. The distance between the nozzle 3 and the rotating disk 1 is kept at approximately 0.75". The direction of the nozzle 3 was held perpendicular to a plane of the radius on which the nozzle travelled and 85° from the rotating disk surface so that the direction of spraying is against that of rotation. The disk was rotated at 2,400 RPM, while the nozzle 3 travelled 0.3 inches per second above the disk 1 in the direction from the inner to outer radius.

The specification disclosed an efficient and effective debris removal system. However, the present invention may be embodied in other specific forms without departing from the spirit or essential attributes thereof and accordingly, reference should be made to the appended claims, rather than to the foregoing specification, as indicating the scope of the invention.

What is claimed is:

1. A method of removing debris from a floptical medium after laser etching, comprising the steps of:

a) mounting said floptical medium on a chuck having a thermal mass, a laser-etched surface of said floptical medium being placed distally to said chuck;

b) rotating said chuck and said floptical medium at a predetermined angular velocity;

c) spraying a low-temperature gas containing ice crystals onto a surface of said rotating floptical medium until said debris are substantially removed, said ice crystals colliding with said debris on said rotating floptical medium and causing said debris to depart from said floptical medium, and d) maintaining said rotating floptical medium above a freezing temperature during step c), said thermal mass of said chuck being substantially larger than that of said floptical medium, said thermal mass preventing said rotating floptical medium from being frozen during said debris removal.

2. A method recited in claim 1 wherein said gas is $CO_2$.

3. A method recited in claim 1 wherein said angular velocity is approximately 2000 rpm.

4. A method recited in claim 1 wherein said chuck is an at least one-inch thick aluminum assembly.

5. A method recited in claim 1 wherein a direction of said spraying is between 0 and less than 90 degrees in a plane perpendicular to said rotating surface, said spraying direction being opposite to said rotation.

6. A method recited in claim 1 wherein a direction of said spraying is perpendicular to said surface of said rotating floptical medium.

7. A method recited in claim 1 wherein a direction of said spraying is between 0 and less than 90 degrees in a plane perpendicular to said rotating surface, said spraying direction being the same as said rotation.

8. A method recited in any one of claims 5–7 wherein said floptical medium is a floptical disk, said floptical disk having stitches said debris remaining in said stitches prior to said spraying, said spraying traversing from an inside to outside radius, each stitch being sprayed by said gas for at least several times.

9. A method recited in claim 1 wherein said thermal mass is replenished by an external heat source.

10. A method recited in claim 1 wherein step c) further comprises a step of applying a low-pressure air in the vicinity of said rotating floptical medium for further transporting said departed debris.

11. A method recited in claim 1 wherein said debris is approximately micron in size.

12. A method of removing microscopic debris from a floptical disk after creating stitches by laser etching, comprising the steps of:

a) mounting said floptical disk on a chuck having a thermal mass, a surface containing said stitches being placed distally to said chuck;

b) rotating said chuck and said floptical disk at a predetermined angular velocity; and c) spraying a low-temperature gas containing ice crystals onto said surface of said rotating floptical disk, said spraying traversing from an inside to outside radius, each stitch being sprayed by said gas for a predetermined number of repetitions until said microscopic debris are substantially removed, said ice crystals colliding with said microscopic debris left in said stitches and causing said microscopic debris to be removed from said stitches; and d) maintaining said rotating floptical disk above a freezing temperature during step c), said thermal mass of said chuck being substantially larger than that of said floptical disk, said thermal mass preventing said rotating floptical disk from being frozen during said microscopic debris removal.

13. A method recited in claim 12 wherein said gas is $CO_2$.

14. A method recited in claim 12 wherein said angular velocity is approximately 2000 rpm.

15. A method recited in claim 12 wherein said chuck is an at least one-inch thick aluminum assembly.

16. A method recited in claim 12 wherein a direction of said spraying is between 0 and less than 90 degrees with respect to said rotating surface in a plane perpendicular to said rotating surface, said spraying direction being opposite to said rotation.

17. A method recited in claim 12 wherein a direction of said spraying is perpendicular to said surface of said rotating floptical medium.

18. A method recited in claim 12 wherein a direction of said spraying is between 0 and less than 90 degrees in a plane perpendicular to said rotating surface, said spraying direction being the same as said rotation.

19. A method recited in claim 12 wherein said predetermined number of repetitions is at least several times.

20. A method recited in claim 12 wherein said thermal mass is replenished by an external heat source.

21. A method recited in claim 12 where said step c) further comprises a step of applying a low-pressure air in the vicinity of said rotating floptical medium for further transporting said departed debris.

22. An apparatus for removing debris from a floptical medium after etching comprising:

rotating means;

a chuck connected to said rotating means for rotating said floptical medium at a predetermined angular velocity, an etched surface of said floptical medium being placed distally to said chuck, said chuck having a thermal mass; and a sprayer adjustably disposed over said etched surface of said rotating floptical medium for spraying a low-temperature gas containing ice crystals onto said rotating etched surface, said ice crystals colliding with said debris and causing said debris to depart from said rotating etched surface, said thermal mass of said chuck being substantially larger than that of said floptical medium, said thermal mass preventing said rotating floptical medium from being frozen during said debris removal;

position adjustment means connected to said sprayer for moving said sprayer in a predetermined path at a predetermined speed over said rotating floptical medium, said rotating etched surface being sprayed by said gas for a predetermined number of repetitions; and means, mounted to said position adjustment means, for angularly adjusting said sprayer independently about two separate axes, to allow adjustment in a circumferential as well as a radial direction with respect to said etched surface.

23. Apparatus according to claim 22 wherein said gas is $CO_2$.

24. Apparatus according to claim 22 wherein said angular velocity is approximately 2000 rpm.

25. Apparatus according to claim 22 wherein said chuck is at least one-inch thick aluminum assembly.

26. Apparatus according to claim 22 wherein said sprayer is placed at a nozzle between 0 and less than 90 degrees in a plane perpendicular to said rotating surface, said sprayer spraying in an opposite direction to said rotation.

27. Apparatus according to claim 22 wherein said sprayer sprays in a perpendicular direction to said surface of said rotating floptical medium.

28. Apparatus according to claim 22 wherein said sprayer is placed at an angle between 0 and less than 90 degrees in a plane perpendicular to said rotating surface, said sprayer spraying in the same direction as said rotation.

29. Apparatus according to any one of claims 26–28 wherein said floptical medium is a floptical disk, said sprayer traversing from an inside to outside radius and allowing each stitch to be sprayed by said gas for at least several times.

30. Apparatus according to claim 22 wherein said thermal mass is replenished by an external heat source.

31. Apparatus according to claim 22, further comprising:

low pressure means connected to a low pressure source and placed near said rotating floptical medium for further transporting said departed debris from said rotating floptical medium towards said low pressure means.

32. An apparatus for removing microscopic debris after laser etching comprising:

a floptical disk having stitches created by laser etching, microscopic debris being left in said stitches and on a surface of said floptical disk;

rotating means;

a chuck connected, to said rotating means for rotating said floptical disk, said surface containing said stitches being placed distally to said chuck, said chuck having a thermal mass;

a sprayer adjustably disposed over said stitched surface of said rotating floptical disk for spraying a low-temperature gas containing ice crystals onto said rotating stitched surface at a predetermined angle with respect to said rotating stitched surface, at a predetermined distance from said rotating stitched surface and in a predetermined direction with respect to that of said rotating stitched surface, said ice crystals colliding with said debris and causing said debris to depart from said rotating stitched surface, said thermal mass preventing said rotating floptical medium from being frozen during said debris removal;

sprayer angle adjustment means connected to said sprayer for varying an angle of said sprayer with respect to said etched surface;

low pressure means connected to a low pressure source and placed near said rotating floptical disk for further transporting said departed debris from said rotating floptical disk towards said low pressure means;

position adjustment means connected to said sprayer for moving said sprayer in a predetermined path at a predetermined speed over said rotating floptical disk, each stitch being sprayed by said gas for a predetermined number of repetitions and means, mounted to said position adjustment means; for angularly adjusting said sprayer independently about two separate axes, to allow adjustment in a circumferential as well as a radial direction with respect to said etched surface.

33. Apparatus according to claim 32 wherein said gas is $CO_2$.

34. Apparatus according to claim 32 wherein said angular velocity is approximately 2000 rpm.

35. Apparatus according to claim 32 wherein said chuck is at least one-inch thick aluminum assembly.

36. Apparatus according to claim 32 wherein said predetermined angle is between 0 and less than 90 degrees in a plane perpendicular to said rotating surface, said sprayer being placed perpendicular to a plane of a radius of said rotating disk, said predetermined direction is the opposite direction to said rotation.

37. Apparatus according to claim 32 wherein said predetermined angle is perpendicular to said surface of said rotating floptical disk.

38. Apparatus according to claim 32 wherein said predetermined angle is between 0 and less than 90 degrees in a plane perpendicular to said rotating surface, said sprayer being placed perpendicular to a plane of a radius of said rotating disk, said predetermined direction is the same direction as said rotation.

39. Apparatus according to claim 32 wherein said predetermined number of repetitions is at least several times.

40. Apparatus according to claim 32 wherein said thermal mass is replenished by an external heat source.

* * * * *